United States Patent [19]

Carlton, Sr.

[11] Patent Number: 4,969,242

[45] Date of Patent: Nov. 13, 1990

[54] TIED SHOELACE SHIELD

[76] Inventor: Darcy M. Carlton, Sr., 1606 Highway 218E, Monroe, N.C. 28110

[21] Appl. No.: 424,519

[22] Filed: Oct. 20, 1989

[51] Int. Cl.[5] ..... F16G 11/00

[52] U.S. Cl. ..... 24/712.3; 24/712.1; 24/712.5

[58] Field of Search ..... 24/712.3, 712.1, 712.2, 24/712.4, 712.5, 712.6, 712; 36/50

[56] References Cited

U.S. PATENT DOCUMENTS

| | | | |
|---|---|---|---|
| 574,484 | 1/1897 | Johnson | 24/712.6 |
| 674,494 | 5/1901 | Brott | 24/712.6 |
| 3,074,135 | 1/1963 | Brodowski | 24/712.5 |
| 3,132,394 | 5/1964 | Russell | 24/712.3 |
| 3,229,340 | 1/1966 | Herdman | 24/712.3 |
| 3,473,198 | 10/1969 | Meier | 24/712.3 |
| 4,715,094 | 12/1987 | Herdman | 24/712.3 |
| 4,790,048 | 12/1988 | Arnt | 24/712.1 |

*Primary Examiner*—Victor N. Sakran

*Attorney, Agent, or Firm*—Warren D. Flackbert

[57] ABSTRACT

A tied shoelace shield defined by two cooperating parts presenting a cavity for receiving the shoelace during tieing and, thereafter, a cover concealing the tied shoelace. The parts of the invention are reversible end-to-end, and foot-to-foot, and serve simplicity for assembly. The shield presents multi-purposes, including better shoelace tightening due to release of pressure from the top of the foot by the shield and, when covered after shoelace tieing, the positive location of the tied shoelace ends within the cavity so as to prevent tripping or the like.

3 Claims, 1 Drawing Sheet

TIED SHOELACE SHIELD

As is known, the unwanted untieing of a shoelace, particularly on a youngster's shoe, is a possible source of harm, resulting in falling, tripping and/or the like. In addition, the preceding serves as a source of stress to others concerned with the welfare of the user, where the problem poses a continual need which is satisfied by the invention herein.

BACKGROUND OF THE INVENTION

The shoelace shield presented by the invention achieves multi-use purposes, including the overlying and containment of the knotted and looped free ends of a tied shoelace for positive positioning and, in addition, the use of the shield to release pressure from the top of the foot and to thereby permit tighter shoelace tying through the distribution of tension on the knot.

Briefly, the instant shoelace shield is in two parts, one overlying the other in a snap fit relationship. Importantly, the cover or upper part of the shield is reversible from end-to-end, and from foot-to-foot, since typically, shield usage is in pairs, meaning a continual and positive assembly to a use condition.

BRIEF DESCRIPTION OF THE FIGURES

In any event, a better understanding of the present invention will become more apparent from the following description, taken in conjunction with the accompanying drawing, wherein.

Figure 1:
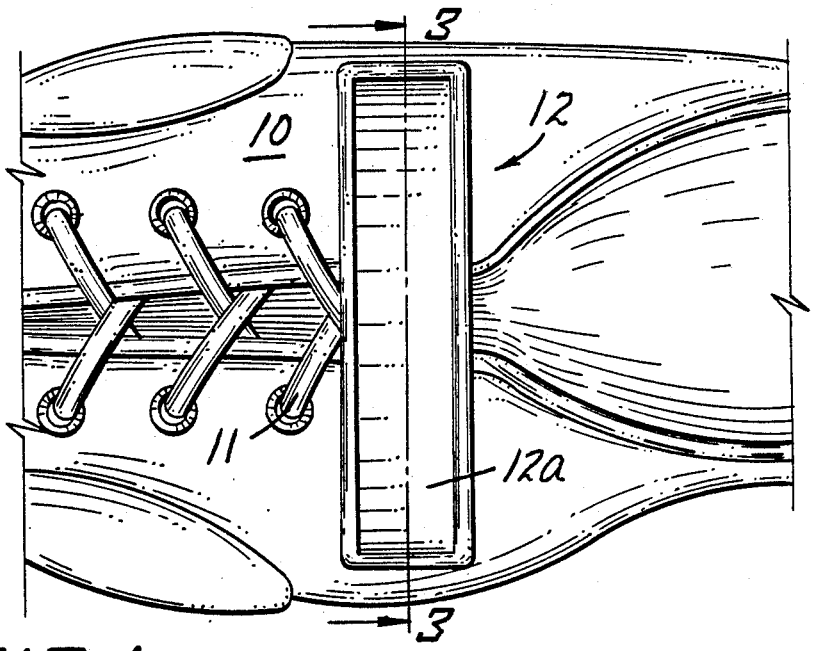
FIG. 1 is a top plan view showing a tied shoelace shield in accordance with the teachings of the present invention in a use condition.
Figure 2:
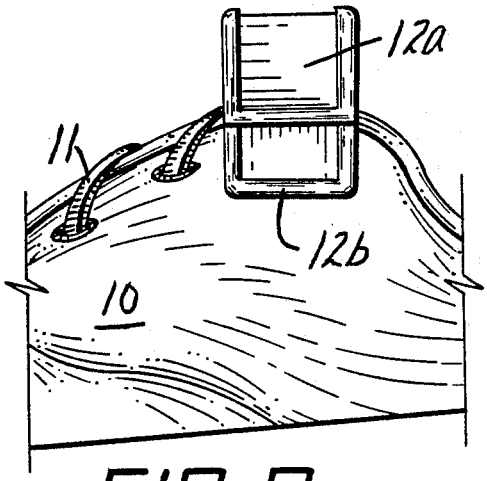
FIG. 2 is a view in side elevation of the instant shoelace shield, looking from the top to the bottom of FIG. 1 or conversely.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the tied shoelace shield 12 of the invention is presented in two parts, viz. an upper part **12*a* and a lower part 12*b***, respectively serving covering and receiving (cavity) purpose. The finished shield is typically fabricated from injection molded plastic resin, promoting durability and lightness in weight.

The upper part or arcuate elongated receiving body cavity **12*a* and the lower part 12*b* are assembled by a snap-fit relationship at each end thereof. In this connection, reference is now made to FIGS. 3, 4 and 5, where upper part 12*a* includes depending members 12*a*′ at either end thereof, each presenting an inwardly projecting latch 12*a*″**.

Figure 3:
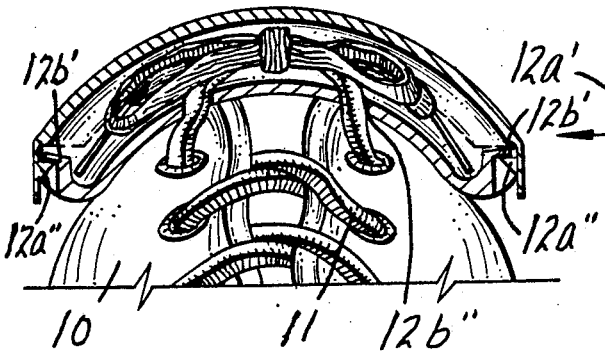
FIG. 3 is a view in vertical section, taken at line 3—3 on FIG. 1 and looking in the direction of the arrows, detailing the invention.
Figure 4:
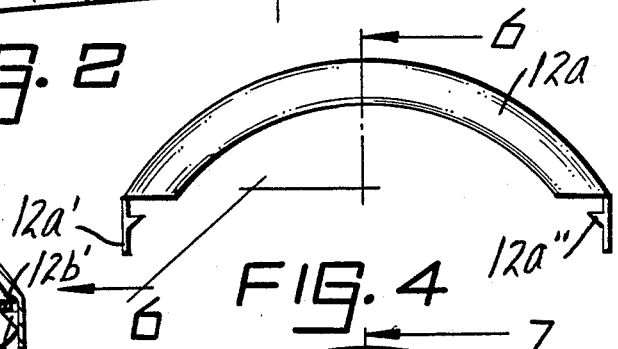
FIG. 4 a view in front elevation showing one part of the instant shoelace shield.
Figure 5:
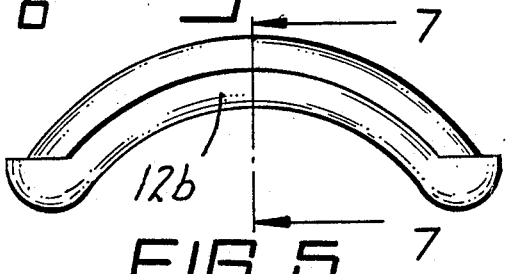
FIG. 5 is another view in front elevation, but in this instance showing the other part of the shoelace shield.

The lower part **12*b* is shown in FIG. 5, but the details of the snap-fit assembly of the upper part 12*a* with the lower part 12*b* are most evident in the showing of FIG. 3, i.e. where the latches 12*a*″ on the upper part 12*a* each selectively engage and bear against a bottom surface of a flange 12*b*′ located on opposite ends of the lower part 12*b***. In other words, positive assembly is assured, from either end, thus, simplifying use for those of younger ages.

Figure 6:
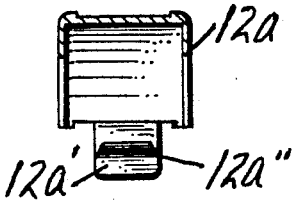
FIG. 6 a view in vertical section, taken at line 6—6 on FIG. 4 and looking in the direction of the arrows, detailing the invention; and, FIG. 7 is still another view in vertical section, in this instance taken at line 7—7 on FIG. 5 and looking in the direction of the arrows, still further detailing the invention.
Figure 7:
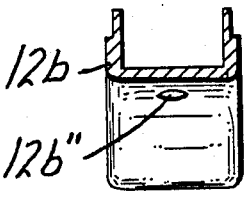

FIGS. 6 and 7 further detail the configuration, in vertical section, of the upper part **12*a* and the lower part 12*b*, where FIG. 6 serves as another showing of the latch 12*a*″**.

In any event, and when used, the shoelace 11 is introduced through openings **12*b*″ in the bottom wall of the lower part 12*b* (again see FIG. 3), where, obviously, the upper part 12*a* has been removed. In tieing the shoelace, the lower part 12*b*** of the shield presents a manner of releasing pressure from the top of the foot, thereby permitting tighter shoelace tieing through distribution of tension on the knot. Importance is presented by this relationship in itself.

The upper part **12*a* is then snap-fit onto the lower part 12*b* in a tied shoelace covering relationship. Thus, the possibility of snagging and/or untieing during shoe 10 use is minimized, where assembly of the upper part or receiving body cavity 12*a* onto the lower part 12*b*** can be accomplished even by a youngster.

As evident, the instant tied shoelace shield serves practical aspects in shoelace tieing and/or in the covering of a tied shoelace, where such is accomplished by only two parts readily assembled by a latching engagement in a snap-fit relationship. The cover or upper part **12*a*** is completely releasable and, as well, reversible end-to-end, and foot-to-foot, since, typically, invention usage is in pairs.

The described tied shoelace shield is susceptible to various changes within the spirit of the invention, including, by way of example, in proportioning; in material selection; the precise manner in achieving a snap-fit cooperating relationship between the presented parts; and, the like. Thus, the preceding should be considered illustrative and not as limiting the scope of the following claims:

I claim:

1. A shield for a shoelace placed in use on a shoe and having tied free ends comprising an arcuate elongated body cavity adapted to receive said tied free ends of said shoelace and disposed in a lateral and overlying relationship with respect to the length of said shoe, a correspondingly shaped arcuate removable lid for said arcuate elongated body cavity serving to conceal and prevent access to said tied free ends of said shoelace, and snap-fit latch means at each end of said arcuate elongated body cavity and said arcuate removable lid retaining said lid onto said body cavity in a selectively reversible end-to-end relationship, where said body cavity has a bottom wall including openings through which said ends of said shoelace extend, serving a pressure release relationship and tighter shoelace tying.

2. The shield of claim 1 where said latch means is defined as an inwardly directed member on each end of said arcuate removable lid in cooperable engagement with a receiving portion disposed at each end of said arcuate elongated body cavity.

3. The shield of claim 2 where said receiving portion is a projection.

* * * * *